US008015710B1

(12) United States Patent
Zyla

(10) Patent No.: US 8,015,710 B1
(45) Date of Patent: Sep. 13, 2011

(54) SHAVING DEVICE AND METHOD OF USE

(76) Inventor: Harley Zyla, Las Vegas, NV (US)

( * ) Notice: Subject to any disclaimer, the term of this patent is extended or adjusted under 35 U.S.C. 154(b) by 611 days.

(21) Appl. No.: 11/424,794

(22) Filed: Jun. 16, 2006

Related U.S. Application Data

(62) Division of application No. 10/855,012, filed on May 27, 2004, now abandoned.

(51) Int. Cl.
*B26B 21/40* (2006.01)

(52) U.S. Cl. ..... 30/34.05; 30/537

(58) Field of Classification Search ..... 30/34.05, 30/50, 55, 59, 60, 60.5, 77, 78, 79, 346.58, 30/539, 540, 537, 51, 54, 61; D28/47
See application file for complete search history.

(56) References Cited

U.S. PATENT DOCUMENTS

| | | | | |
|---|---|---|---|---|
| 1,299,382 | A | | 4/1919 | Raymond |
| 1,534,312 | A | | 4/1925 | Goza |
| 3,172,202 | A | | 3/1965 | Sooter |
| 3,177,582 | A | | 4/1965 | Carl |
| D210,713 | S | | 4/1968 | Hamill |
| 3,384,961 | A | | 5/1968 | Donovan |
| 3,388,468 | A | | 6/1968 | Hamill |
| 3,530,574 | A | | 9/1970 | Patterson |
| 3,576,071 | A | | 4/1971 | Eriksen |
| 3,675,325 | A | | 7/1972 | Michelson |
| D226,642 | S | | 4/1973 | Ferrier |
| 3,750,285 | A | | 8/1973 | Michelson |
| 3,972,114 | A | * | 8/1976 | Chao et al. ..... 30/41 |
| 4,739,553 | A | | 4/1988 | Lazarchik |
| 4,912,846 | A | | 4/1990 | Yu |
| 4,914,817 | A | * | 4/1990 | Galligan et al. ..... 30/77 |
| 4,996,772 | A | | 3/1991 | Iten |
| 5,090,124 | A | * | 2/1992 | Althaus ..... 30/50 |
| 5,095,621 | A | | 3/1992 | Rapp |
| 5,386,750 | A | | 2/1995 | Morrison |
| 5,630,275 | A | | 5/1997 | Wexler |
| 6,263,576 | B1 | | 7/2001 | Drapak |
| 6,393,706 | B1 | | 5/2002 | Ferraro |
| 6,418,623 | B1 | | 7/2002 | Marcarelli |
| 2002/0083600 | A1 | | 7/2002 | Donovan |

* cited by examiner

*Primary Examiner* — Hwei-Siu C Payer
(74) *Attorney, Agent, or Firm* — Greenberg Traurig

(57) ABSTRACT

A shaving device includes one or more collars for shielding certain portions of one or more razor blades. In one version, the collars include a rubber membrane for shielding the razor blades. The collars may or may not slide along a razor head containing one or more razor blades. The combination of the shielded and unshielded razor blade portions facilitates the creation of unique and intricate facial hair designs. The collars may also be used with replacement razor blade cartridges. An alternative design includes a shaving device wherein each razor blade is formed of two or more blade sections separated by partitions integrated into the head of the shaving device. Although ideal for facial hair, the shaving device is useful with any body hair.

4 Claims, 3 Drawing Sheets

SHAVING DEVICE AND METHOD OF USE

CROSS REFERENCE TO RELATED APPLICATION

This application is a divisional of application Ser. No. 10/855,012 filed May 27, 2004, now abandoned.

FIELD OF THE INVENTION

The present invention relates to a shaving device and method for creating intricate designs in concentrations of body hair.

BACKGROUND

The trend today is for the younger generation (i.e., the X generation) to set themselves apart in every conceivable way. For example, they wear loose fitting clothing and backwards caps to exude a casual and laid back persona. They also wear facial hair styles to convey their persona. In fact, creating distinct facial hair designs is very popular. Similarly, for those exhibiting short hair, shaving designs into one's head has become relatively common. However, as set forth above, creating the designs using a conventional off-the-shelf disposable bladed razor or replaceable bladed razor is tedious and inexact.

Thus, there continues to be a need for a bladed razor which facilitates the simple creation of intricate facial hair designs. Moreover, while the bladed razor should be ideal for facial hair, it should not be limited to facial hair.

SUMMARY

Accordingly, a first embodiment of the present invention comprises a sleeve or collar attached to a single or double bladed disposable razor. The sleeve or collar is fabricated, at least in part, of a pliable material such as rubber, latex or similar material. In one embodiment, the collar is slidably attached to a head of the razor and shields a portion of the razor blade or blades. As such, the collar or collars are adjustable along the length of the razor blades. The collars dictate which portion of the razor blade or blades are prevented from contacting a user's skin and facial hair. In this manner, the collars prevent specific hair from being removed while other hair is removed by the unshielded portion of the razors as desired. Any number of collars or collar designs may be used to create an infinite number of hair designs.

For example, a first collar arrangement may cover a central portion of the razor blades thereby leaving a strip of facial hair between two shaved strips. By using a second collar design or two of the first collar designs to cover two spaced portions of the razor blades, a user may create two strips of facial hair bordering a shaved strip. Other combinations and collar designs are obviously conceivable.

In another embodiment, the collars are designed for slidable attachment to a razor blade housing used in conjunction with shaving devices having replaceable razor blades. Typically, the housing contains one or more razor blades and removably attaches to the end of a razor handle. When the blades become dull, the housing is removed from the handle and replaced with a new housing and corresponding razor blades. While the razor blades are disposable, the handle portion of the shaving device is retained for subsequent use.

The collar embodiments may be incorporated on the disposable razors or replaceable razor housings at the time of manufacture or may be supplied separately so that users may attach the collars as desired. In either case, the collars are removable to facilitate user needs.

In another embodiment of the shaving device, the head of the device contains one or more razor blades wherein each razor blade comprises multiple sections separated by partitions in the head. This embodiment is fixed unlike the slidable collar embodiments. Such an embodiment is fabricated at the manufacturing level. The fixed design may also be incorporated in the replaceable razor housings disclosed above.

DETAILED DESCRIPTION

Although the following description focuses on facial hair, the embodiments of the present invention are not so limited. To the contrary, the embodiments are useful with any concentration of body hair.

Figure 1:
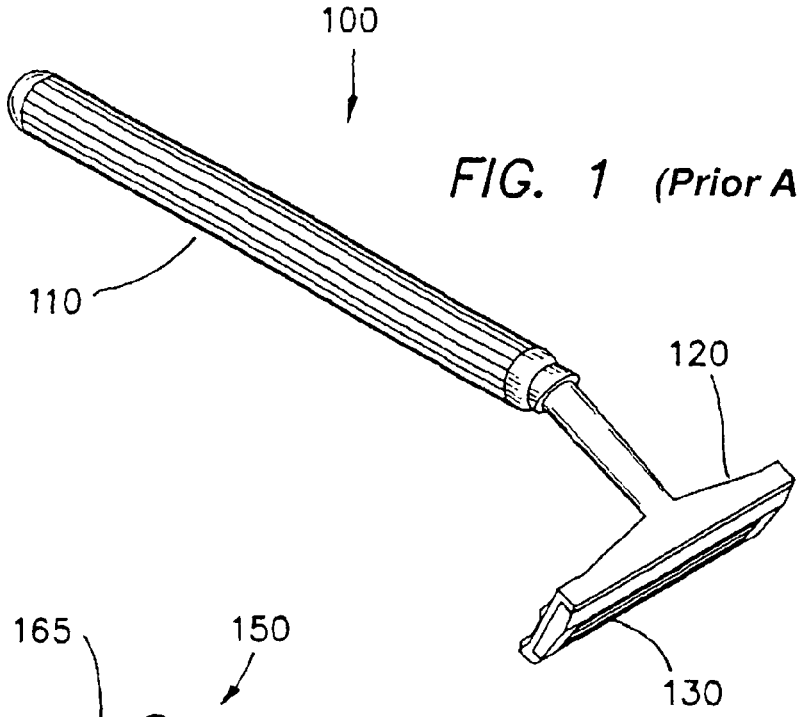
FIG. 1 (Prior Art)
FIG. 1 shows a perspective view of a conventional disposable bladed razor.

Reference is now made to the figures wherein like parts are referred to by like numerals throughout. FIG. 1 illustrates a perspective view of a conventional disposable razor generally referred to by reference numeral 100. The disposable razor 100 comprises a handle 110, head 120 and two parallel blades 130. It should be understood that the embodiments of the present invention are not limited to double bladed razors but may be integrated with any type of bladed razor, including a single or triple bladed razor.

Figure 2:
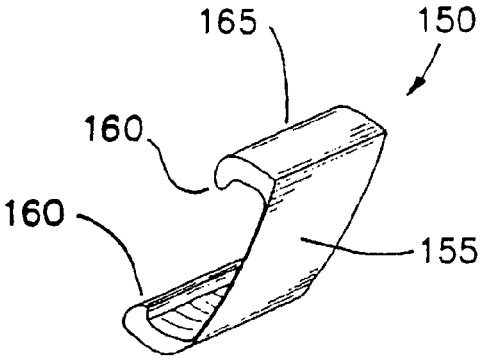
FIG. 2 shows a first collar of one embodiment of the present invention.

FIG. 2 shows a first collar 150 comprising a single membrane 155 and clips 160 for attaching the collar 150 to the disposable razor 100. Ideally, the membrane 155 is a thin piece of rubber, latex or similar pliable material. Other materials may also achieve the same objective. In this manner, during use the membrane 155 rests flush against the blades 130 of the razor 100. The clips 160, which hold the membrane, are fabricated of a rigid material to secure the collar 150 to the razor blade head 120. The collar 150 may be an after-market product to accommodate different brands of razors (e.g., Bic® or Gillette®). In such instances, the dimensions of the collar 150 and clips 160 will likely need to be altered accordingly. Alternatively, the collars 150 may be manufactured and packaged with a corresponding brand-named razor or uniquely designed razor.

Figure 3:
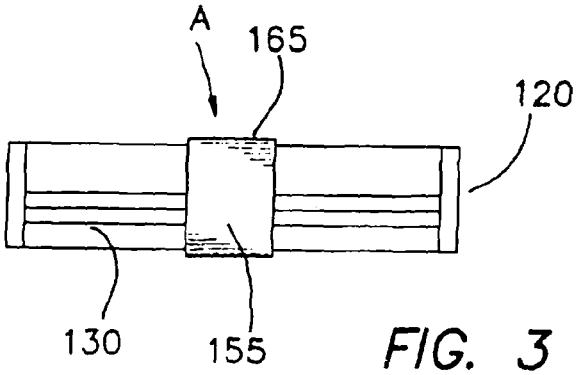
FIG. 3 shows the first collar of one embodiment of the present invention attached to a razor head.

In any case, as shown in FIG. 3, the collar 150 is slidably attached to the head 120 of the razor 100. In this manner, the collar 150 may be positioned at any point along the length of the head 120. However, the collar 150 should be snugly fitted to the head 120 to prevent undesired movement during the shaving process. Also, positioning the collar 150 should be accomplished by applying pressure (in the direction of arrow A) to the collar 150 near a top portion 165 thereof. Applying pressure to the top portion 165 of the collar 150 reduces the likelihood of injury which may be caused should fingers slide off the collar 150 and into the blades 130. By applying pressure to the top portion 165 of the collar 150, fingers, if they slide off the collar 150, will only contact the dull upper surfaces of the razor blades 130.

While the clips 160 are shown as rounded to conform to the head 120 of the razor 100, they can take any shape or form suitable for slidably attaching to the head 120. Moreover, different razor head designs may facilitate different clip 160 designs.

Figure 4:
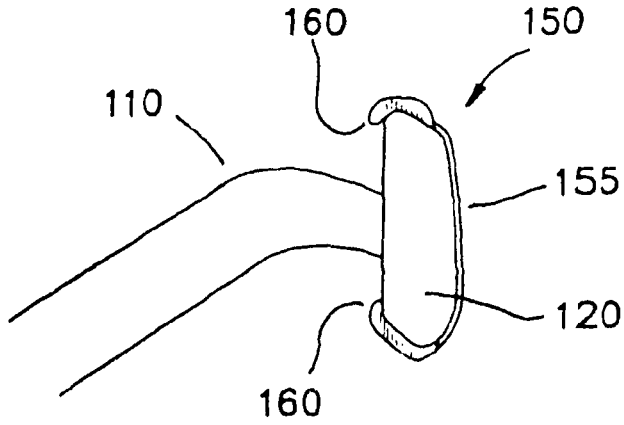
FIG. 4 shows a cross-sectional view of the collar attached to the razor head.

During use, the membrane 155 of the collar 150 shields a portion of the razor blades 130 from contacting the user's skin and facial hair leaving the facial hair in place. Therefore, facial hair designs may be accurately created by shaving some portions of hair and leaving other portions of hair untouched. Although, FIG. 3 shows only a single collar 150 attached to the head 120 of the razor 100, multiple collars 150 may be attached to the head 120 of the razor 100 to create different designs. FIG. 4 shows a cross-sectional view of the collar 150 in place on the head 120 of the razor 100. It should be understood that the membrane 155 is shown to be distanced from the razor blade head 120, but in practice the membrane 155 may be substantially flush with the head 120.

Figure 5:
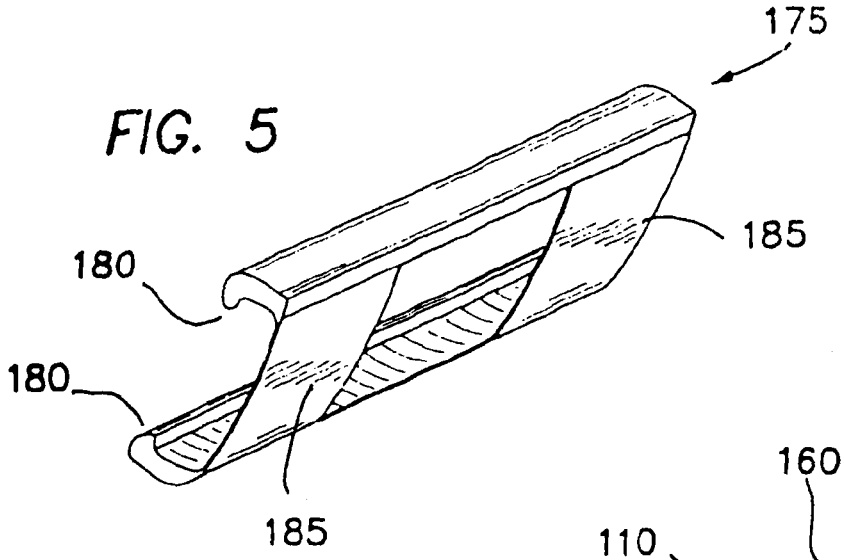
FIG. 5 shows a second collar of one embodiment of the present invention.
Figure 6:
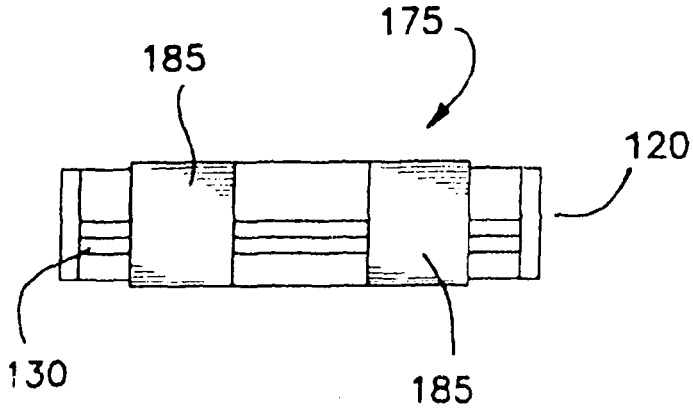
FIG. 6 shows the second collar of one embodiment of the present invention attached to a razor head.

FIGS. 5 and 6 show a multi-membrane collar 175 having clips 180 for attachment to the head 120 of the razor 100. The multi-membrane collar 175 eliminates the need for attaching multiple single collars 150 to the head 120 of the razor 100. Also, the prefabricated multi-faced collar 175 ensures an accurate spacing between membranes 185 so that facial hair patterns are exact to manufacturing tolerances.

Figure 7:
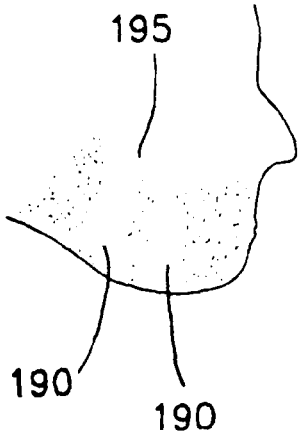
FIG. 7 shows a facial hair design created using the collar shown in FIGS. 2 and 3.
Figure 8:
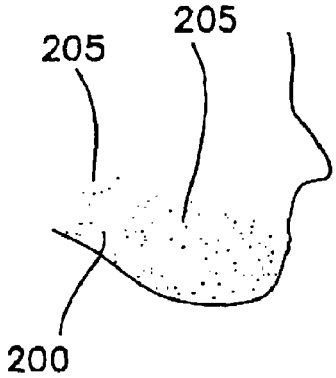
FIG. 8 shows a facial hair design created using the collar shown in FIGS. 4 and 5.

FIGS. 7 and 8 show facial hair designs created using a single collar 150 and multi-membrane collar 175, respectively. The hair design of FIG. 7 can be created easily using the razor 100 employing the single collar 150 as arranged in FIG. 3. In this manner, two areas 190 are shaved and an intermediate area 195 remains unshaved. The design of FIG. 8 is created by means of the razor 100 employing the multi-membrane collar 175. In this manner, a single shaved area 200 is bordered by two unshaved areas 205. The facial hair designs shown in FIGS. 7 and 8 would be very difficult, if not impossible, to create using a conventional bladed razor. While only generally vertical designs are shown, any directional designs may be created using the embodiments of the present invention. Any number of collar designs may be used to create even more intricate or pre-established facial hair designs.

It should be understood that the embodiments of the present invention may be used in conjunction with a razor blade cartridge designed for receipt by a razor handle. In this manner, the cartridge and blades are used until the blades become dull at which time the old cartridge is disposed of and a new cartridge is attached to the razor handle. As described above, a collar may be attached to the cartridge at the time of sale or may be provided separately for after market use with the cartridge.

Figure 9:
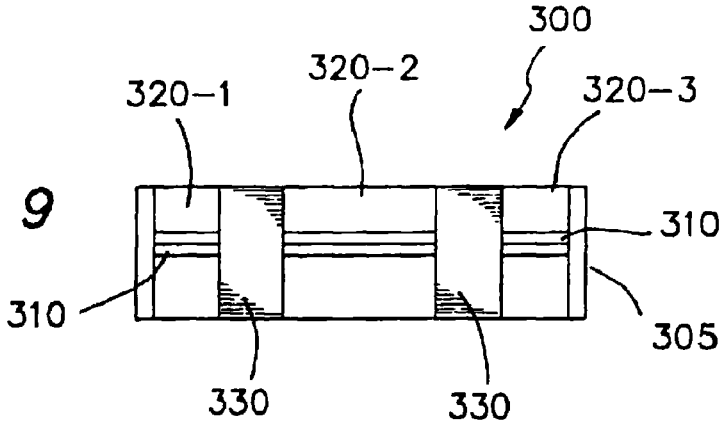
FIG. 9 shows a third embodiment of the present invention.

FIG. 9 shows a third embodiment of the present invention wherein collars are replaced with fixed breaks or partitions in the razor blades. In such an embodiment, the shaving device 300 is manufactured to include a head 305 and two razor blades 310 comprising three independent blade sections 320-1 through 320-3. Permanent partitions 330 separate each blade section 320-1 through 320-3 and achieve the same objective as the collars 150, 175 disclosed above. With the third embodiment, the blades 310 may comprise any number of sections to facilitate a multitude of different facial hair designs. The partitions 330 are fixed and therefore provide less versatility than the slidable collars 150. However, the fixed partitions 330 may be efficiently manufactured so that the head 305 is fabricated as a single unit.

Figure 10:
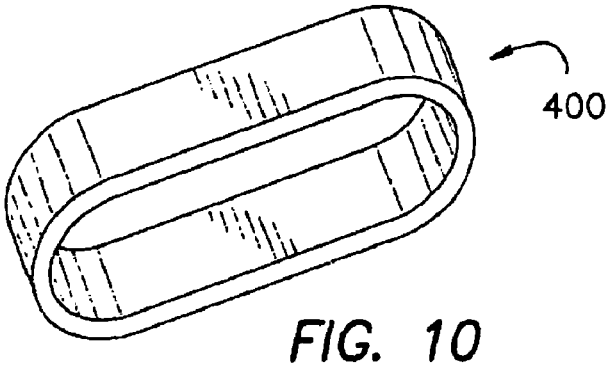
FIG. 10 shows a fourth embodiment of the present invention.

FIG. 10 shows a flexible band 400 which may be positioned along the razor blade head 120 to shield a portion of the razor blades 130. Multiple bands 400 may be used to create different facial hair patterns. The bands 400 may be fabricated of rubber or similar elastic materials. Ideally, the bands 400 are sized to fit tightly over the razor blade head 120. Additionally, the bands 400 may be specifically pre-fabricated to fit brand named razor blade heads 120.

Figure 11:
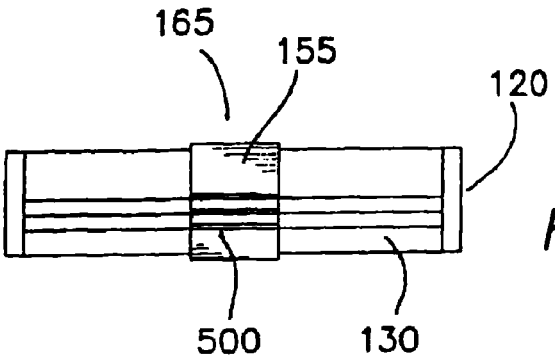
FIG. 11 shows a fifth embodiment of the present invention.

As shown in FIG. 11, it is also contemplated that the membrane 155 may incorporate grooves 500 which mimic the shielded razor blades 130. In this manner, the grooves 500 help maintain the unshaven underneath the membrane 155. If hair escapes from underneath the membrane 155 and is cut by the blades 130, the resulting shave may not be ideal. The groves 500 may be incorporated into any of the embodiments of the present invention including membrane 175 and band 400.

While several of the embodiments of the present invention utilize clips for retaining a membrane, other designs may facilitate placement of the membrane over the razor blades. For example, the membranes may incorporate an adhesive at upper and lower ends, rather than clips, for temporary attachment to the head of the razor blade.

Moreover, although the invention has been described in detail with reference to several embodiments, additional variations and modifications exist within the scope and spirit of the invention as described and defined in the following claims.

I claim:

1. A shaving device comprising:

a head attached to a handle; and one or more parallel rows of razor blades wherein each row of razor blades comprises multiple razor blade portions segmented by at least one removable partition wherein said partition is slidably received along a longitudinal length of said rows of razor blades, said razor blade portions contained by said head wherein said partition is substantially flush with said razor blades such that said razor blades contact a user's skin during use of said shaving device.

2. The shaving device of claim 1 wherein said at least one removable partition comprises one partition such that the one or more rows each include two aligned razor blade portions.

3. The shaving device of claim 1 wherein said at least one removable partition comprises two partitions such that the one or more rows each include three aligned razor blade portions.

4. The shaving device of claim 1 wherein smooth.

* * * * *